US009411301B2

(12) United States Patent
Suzuki et al.

(10) Patent No.: US 9,411,301 B2
(45) Date of Patent: Aug. 9, 2016

(54) FRAME FOR IMAGE FORMING APPARATUS AND MANUFACTURING METHOD THEREOF

(71) Applicant: CANON KABUSHIKI KAISHA, Tokyo (JP)

(72) Inventors: Tetsuji Suzuki, Fujisawa (JP); Masatoshi Yamashita, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/607,354

(22) Filed: Jan. 28, 2015

(65) Prior Publication Data

US 2015/0220047 A1 Aug. 6, 2015

(30) Foreign Application Priority Data

Jan. 31, 2014 (JP) ..... 2014-016830

(51) Int. Cl.
*G03G 21/16* (2006.01)

(52) U.S. Cl.
CPC .... *G03G 21/1619* (2013.01); *G03G 2215/0132* (2013.01); *Y10T 29/49908* (2015.01)

(58) Field of Classification Search
CPC ... B23P 11/00; B23P 11/005; G03G 21/1619; Y10T 29/49924; Y10T 29/49925; Y10T 29/49936; Y10T 29/49908; B21D 39/03; B21D 39/031; F16B 17/008; F16B 5/045
See application file for complete search history.

(56) References Cited

U.S. PATENT DOCUMENTS

| | | | | |
|---|---|---|---|---|
| 3,919,955 | A * | 11/1975 | DuVernay | B21D 39/035 29/21.1 |
| 5,801,728 | A | 9/1998 | Yanagi et al. | |
| 8,262,330 | B2 | 9/2012 | Ishino et al. | |
| 2003/0002916 | A1* | 1/2003 | Bishop | B21D 39/03 403/278 |
| 2009/0142106 | A1* | 6/2009 | Kondo | G03G 15/0812 399/274 |
| 2009/0151146 | A1* | 6/2009 | Nagai | B21D 39/032 29/522.1 |

FOREIGN PATENT DOCUMENTS

| | | | |
|---|---|---|---|
| JP | 11-165448 | A | 6/1999 |
| JP | 2003-237176 | A | 8/2003 |
| JP | 2005-9560 | A | 1/2005 |
| JP | 2005-163818 | A | 6/2005 |
| JP | 2006-202797 | A | 8/2006 |
| JP | 2007-21525 | A | 2/2007 |
| JP | 2008181810 | A * | 8/2008 |
| JP | 2010-204247 | A | 9/2010 |
| JP | 2013-61382 | A | 4/2013 |

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A frame for an image forming apparatus, includes: first and second plate members; a bent portion provided as a part of the first plate member and bent along the second plate member; a portion-to-be-fixed provided as a part of the bent portion; a positioning portion, provided on the first plate member, for positioning the second plate member relative to the first plate member by being abutted vertically against the second plate member, wherein a free end projects toward the second plate member more than the portion-to-be-fixed; and a fixing portion, provided as a part of the second plate member, to which the portion-to-be-fixed is fixed. The second plate member is deformed to contact and deform the fixing portion to the portion-to-be-fixed while the second plate member is in contact to the positioning portion, so that the first plate member and the second member are fixed to each other.

16 Claims, 9 Drawing Sheets

FRAME FOR IMAGE FORMING APPARATUS AND MANUFACTURING METHOD THEREOF

FIELD OF THE INVENTION AND RELATED ART

The present invention relates to a frame for an image forming apparatus and a manufacturing method of the frame.

In recent years and in order to meet demands for downsizing and price reduction, designed cost reduction efforts have been made repeatedly to the image forming apparatus. In a conventional image forming apparatus, a metal plate-combined frame, which is a combination of simple metal plates, has been employed as a frame (casing) for mounting parts of an entirety of a main assembly. The metal plate-combined frame has advantages, compared with a large-sized integral mold frame or the like, such that a material cost is stable, accuracy is easily ensured, mold investment is less, parts are flat plates, and therefore, a distribution cost is low.

The metal plate-combined frame is constituted by left and right side plates, flat metal plates such as an optical stay for mounting an optical scanning unit using a laser or an LED, a main stay for mounting a paper feeding system and a process unit, and a bottom plate for reinforcing a bottom portion of the main assembly. The optical stay, the main stay, and the bottom plate fixed at their ends to the left and right side plates by a fastening member such as screws or by a fixing method such as welding.

In the metal plate-combined frame, the parts constituting the frame are flat plates, and therefore there is a problem such that rigidity with respect to directions of bending and torsion is weak. When the rigidity of the frame is weak, an entirety of the image forming apparatus contorts and thus positional relationships among various parts held by the frame are disordered, so that distance accuracy between respective parts cannot be maintained. Particularly, between the optical scanning unit and a photosensitive member, in the case where the distance accuracy cannot be ensured, there is a liability that major defect, in terms of an image quality, such as image distortion or color misregistration generates.

In order to compensate for insufficient strength of the frame as described above, changes are made, such as the thickness of the metal plate is increased, a reinforcing member is added, increasing the number of parts, weight, cost, and the like, thus being contrary to downsizing and low price. In order to solve this problem, there are constructions in which the frame rigidity is ensured by a shape such as drawing of the frame and in which arrangement of frames is devised. For example, Japanese Laid-Open Patent Application (JP-A) 2003-237176 discloses a construction in which the optical stay and the bottom plate are substantially horizontally disposed and the main stay is obliquely disposed along a paper feeding guide or a feeding guide at an angle of 30 degrees to 60 degrees with respect to a substantially horizontal surface. In this embodiment, even when a force is applied from any direction, bending (distortion) of the frame can be obviated by supporting components of the image forming apparatus by associated one of the flat metal plate parts.

A means of ensuring distance accuracy between a fastening portion and a side plate in the metal plate-combined frame of an image forming apparatus in a conventional example will be described with reference to FIGS. 9 - 12. FIG. 9 is a perspective view of an outer appearance of a metal plate-combined frame in the conventional example. FIG. 10 is a schematic sectional view of the metal plate-combined frame in the conventional example. FIG. 11 is a perspective view of an outer appearance of an optical stay in the conventional example.

FIG. 12 is a schematic view for illustrating fastening between the optical stay and the side plate in the conventional example.

As shown in FIGS. 9 and 10, in a conventional metal plate-combined frame 100, a supporting stay such as an optical stay 101 or a main stay 102 which are a flat metal plate includes a flat plate portion 105 and a bent portion 106 vertically bent from the flat plate portion 105. The bent portion 106 is constituted so as to be parallel to left and right side plates 103 and 104. The supporting stays such as the optical stay 101 and the main stay 102 are fastened to the left and right side plates 103 and 104 at the bent portions 106 which are end portions thereof by fastening means 107 such as screws.

Further, as shown in FIG. 11, the supporting stay such as the optical stay 101 or the main stay 102 is provided with abutment portions 108 at end portions of the flat plate portion 105. As shown in FIG. 9, the abutment portions 108 abut against the left and right side plates 103 and 104, so that the conventional metal plate-combined frame 100 is capable of ensuring the press accuracy belt the left and right side plates 103 and 104.

Further, as shown in FIG. 12, in the conventional metal plate-combined frame 100, the abutment portions 108 somewhat project relative to the bent portion 106. This is because even when the bent portions 106 of the supporting stays such as the optical stay 101 and the main stay 102 open within a variation range of an angular tolerance, the abutment portions 108 are abutted against the left and right side plates 103 and 104 with reliability. The reason why this constitution is employed is that the abutment portion 108 is better in distance accuracy than the bent portion 106.

However, in the metal plate-combined frame of the conventional image forming apparatus shown in FIGS. 9-12, the following problem occurred. In a constitution in which the supporting stay as a first plate member is provided with the abutment portions 108, as shown in FIG. 12, before the left and right side plates 103 and 104 as a second plate member and the bent portions 106 are fastened, a spacing (gap) 109 is formed between the left and right side plates 103 and 104 and the bent portions 106.

On the other hand, when the left and right side plates 103 and 104 and the bent portions 106 are fastened, and the left and right side plates 103 and 104 and the bent portions 106 are not closely contacting each other at peripheries of fastening means 107, e.g., in the case where screws are used as the fastening means 107, a loosening torque of the screws after the fastening lowers. In a state in which the loosening torque is low, screw deviation is caused due to impact (shock) or the like during transportation of the image forming apparatus, so that the entirety of the image forming apparatus is distorted in some cases. Also in the case where a fixing method using, e.g., welding is used as the fastening means 107, improper welding is caused in some cases when the left and right side plates 103 and 104 and the bent portions 106 are not closely contacted to each other, and similarly as in the case of the screws, the entirety of the image forming apparatus is distorted in some cases.

In order to solve this problem, as shown in FIG. 13, there is a constitution in which a slit 110 is provided at a base portion or the like of each of the bent portions 106 in the neighborhood of a fastening portion in order to bring the left and right side plates 103 and 104 and the bent portions 106 described above in close contact with each other with reliability. By this constitution using the slit 110, rigidity of the bent portion 106 lowers. As a result, e.g., in the case where the screws are used as the fastening means 107, in a fastening step using the screws, the bent portions 106 can be reliably deformed by being pulled in the directions of the left and right side plates 103 and 104. However, in this constitution, the slit 110 is provided at the base portion of each of the bent portions 106, and therefore the frame rigidity as the entire of the metal plate-combined frame becomes low.

In place of the slit 110, there is also a constitution in which a projected portion 111 projected in a free end direction by bending a part of the bent portion 106 as shown in FIG. 14. By such a constitution, the fastening means 107 is spaced from the base portion of the bent portion 106, whereby the left and right side plates 103 and 104 and the bent portions 106 can be closely contacted to each other with reliability. When the fastening means 107 is spaced from the base portion of the bent portion 106 and a width of the projected portion 111 is narrow, the rigidity with respect to a bending direction at a periphery of the fastening means 107 lowers. For that reason, e.g., in the case where the screws are used as the fastening means 107, the bent portions 106 are easily pulled in the directions of the left and right side plates 103 and 104. However, the part of the bent portions 106 projects, and therefore the supporting stay is upsized correspondingly. As a result, there is a liability that the supporting stay itself increases in cost. Further, there is a need to provide a fastening position of the fastening means 107 in a position spaced from a body portion of the supporting stay to some extent, and therefore there is a liability that the image forming apparatus is upsized correspondingly.

SUMMARY OF THE INVENTION

A principal object of the present invention is to maintain and improve rigidity of a frame for an image forming apparatus, while suppressing an increase in cost and upsizing of the image forming apparatus.

According to an aspect of the present invention, there is provided a frame for an image forming apparatus, comprising: a first plate member and a second plate member; a bent portion provided as a part of the first plate member and bent along the second plate member; a portion-to-be-fixed provided as a part of the bent portion and to be fixed to the second plate member; a positioning portion, provided on the first plate member, for positioning the second plate member relative to the first plate member by being abutted vertically against the second plate member, wherein a free end of the positioning portion is disposed in a position where the free end projects toward the second plate member more than the portion-to-be-fixed; and a fixing portion, provided as a part of the second plate member, to which the portion-to-be-fixed is fixed, wherein the second plate member is deformed to contact and deform the fixing portion to said portion-to-be-fixed while the second plate member is in contact to the positioning portion, so that the first plate member and the second member are fixed to each other.

According to another aspect of the present invention, there is provided a manufacturing method of a frame for an image forming apparatus, wherein the frame includes a first plate member, a second plate member, a positioning portion, provided on the first plate member, for positioning the second plate member relative to the first plate member by being abutted vertically against the second plate member, a bent portion provided as a part of the first plate member and bent along the second plate member, a portion-to-be-fixed provided as a part of the bent portion and to be fixed to the second plate member, and a fixing portion, provided as a part of the second plate member, to which the portion-to-be-fixed is fixed, and wherein a free end of the positioning portion is disposed in a position where the free end projects toward the second plate member more than the portion-to-be-fixed, the manufacturing method comprising: a positioning step of positioning the second plate member relative to the first plate member by vertically abutting the positioning portion against the second plate member; and a fixing step of fixing the first plate member and the second plate member to each other by deforming the second plate member to contact and deform the fixing portion to the portion-to-be-fixed while the second plate member is in contact to the positioning portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Hereinbelow, embodiments of the present invention will be specifically described with reference to the drawings.

However, dimensions, materials and shapes of constituent elements and their relative arrangements and the like described in the following embodiments should be changed appropriately depending on structures and various conditions of apparatuses (devices) to which the present invention is applied, and the scope of the present invention is not intended to be limited to the following embodiments.

(Image forming apparatus)

Figure 1:
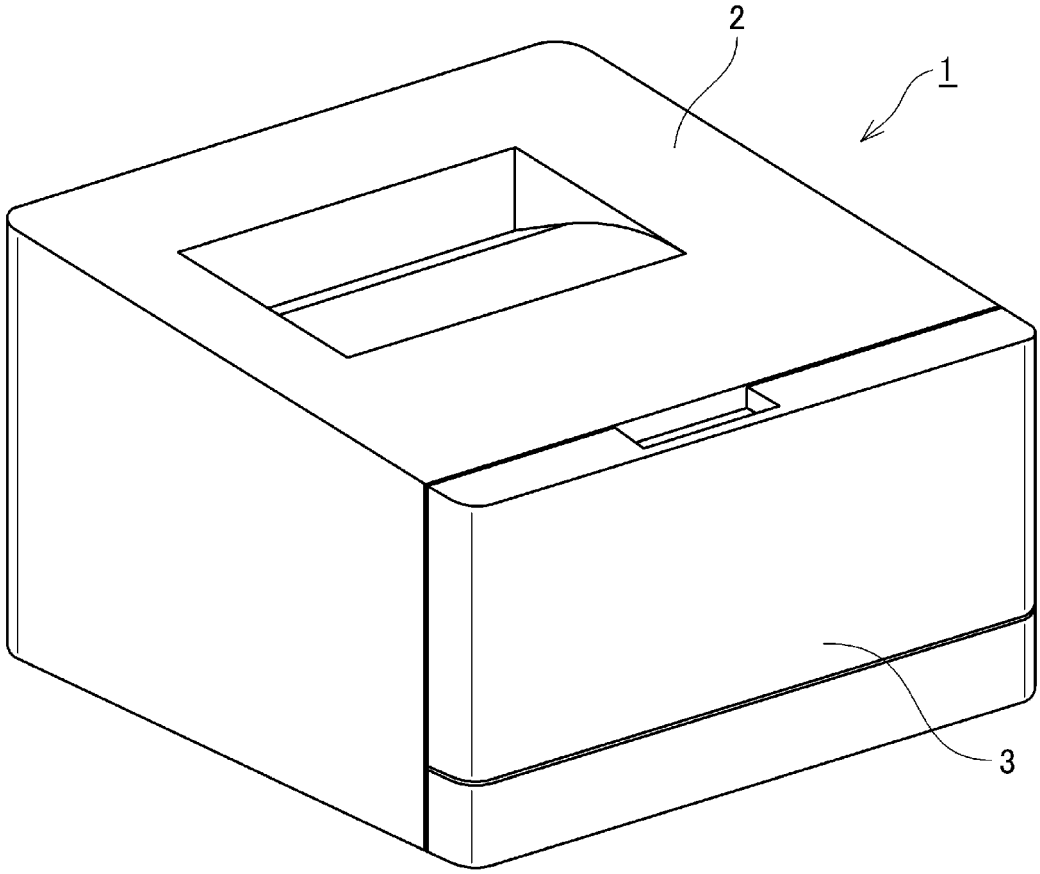
FIG. 1 is a perspective view of an outer appearance of an image forming apparatus in an embodiment.
Figure 2:
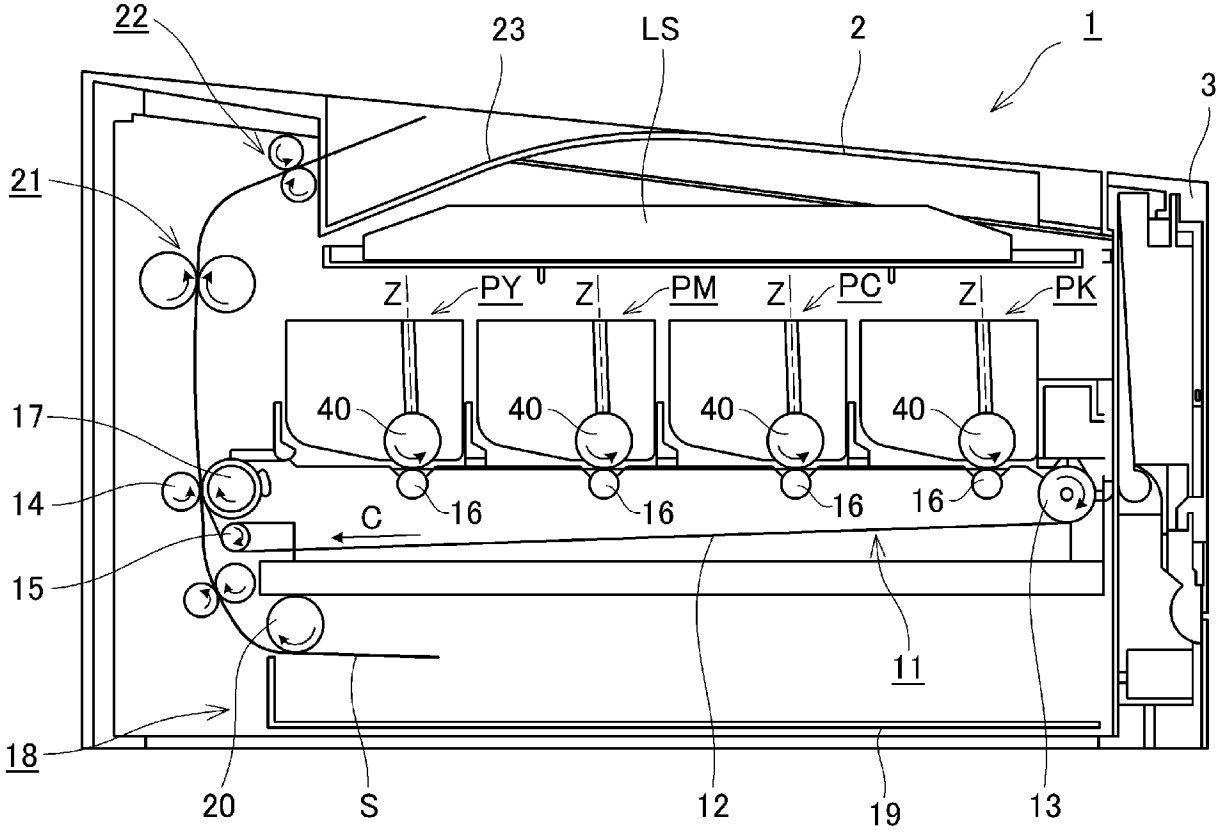
FIG. 2 is a schematic sectional view showing a structure of the image forming apparatus in the embodiment.

First, with reference to FIGS. 1 and 2, a general structure of an image forming apparatus in an embodiment of the present invention will be described. FIG. 1 is a perspective view of an outer appearance of the image forming apparatus in this embodiment. FIG. 2 is a schematic sectional view showing a structure of the image forming apparatus in this embodiment.

An electrophotographic image forming apparatus 1 in this embodiment is a four-color based full-color laser printer using an electrophotographic process. However, the present invention is not limited thereto, but may also be, e.g., an electrophotographic copying machine, an electrophotographic printer (such as a color LED printer), a facsimile machine and a word processor. The image forming apparatus 1 employs a process cartridge type in which a process cartridge P is detachably mounted into an apparatus main assembly 2 through an apparatus openable door 3. The apparatus main assembly 2 is a portion of the image forming apparatus 1 from which the process cartridge P is removed. The image forming apparatus 1 in this embodiment forms a color image on a recording material S. On the recording material S, the image is formed by the image forming apparatus 1, and examples of the recording material S may include a sheet, an OHP sheet and the like.

As shown in FIG. 2, in the apparatus main assembly 2, four cartridges P consisting of a first cartridge PY, a second cartridge PM, a third cartridge PC and a fourth cartridge PK are provided horizontally. The first to fourth cartridges P (PY, PM, PC, PK) have a similar electrophotographic process mechanism and are different from each other in color of developers (toners) accommodated in the cartridges.

The first cartridge PY accommodates the toner of yellow (Y) and forms a developer image (toner image) of yellow (Y) on the surface of a photosensitive drum 40. The second cartridge PM accommodates the toner of magenta (M) and forms a toner image of magenta (M) on the surface of a photosensitive drum 40. The third cartridge PC accommodates the toner of cyan (C) and forms a toner image of cyan (C) on the surface of a photosensitive drum 40. The fourth cartridge PK accommodates the toner of black (K) and forms a toner image of black (K) on the surface of a photosensitive drum 40. Each of the cartridges includes an unshown charging means and an unshown developing means.

To each of the first to fourth cartridges P (PY, PM, PC, PK), from a drive output portion (not shown) of the apparatus main assembly 2, a rotational driving force is transmitted. In each of the first to fourth cartridges P (PY, PM, PC, PK), from the apparatus main assembly 2, bias voltages (charging bias and developing bias) are supplied to the charging means and the developing means (not shown).

Above the first to fourth cartridges P (PY, PM, PC, PK), a laser scanner unit LS as an exposure unit is provided. This laser scanner unit LS outputs laser light Z corresponding to image information. The surface of the photosensitive drum 40 is scanned and exposed to the laser light Z passing through an exposure window portion of each cartridge P.

A toner image forming process is as follows. First, each photosensitive drum 40 is electrically charged by the charging means and then is exposed to light by the laser scanner unit LS to form a latent image thereon. Then, the toner is deposited on the photosensitive drum 40 by the developing means, so that the toner image is formed on the photosensitive drum 40.

Below the first to fourth cartridges P (PY, PM, PC, PK), an intermediary transfer belt unit 11 as a transfer unit is provided. The intermediary transfer belt unit 11 includes a tension roller 13, a driving roller 17 and an assist roller 15 by which a flexible transfer belt 12 is extended and stretched.

Each of the photosensitive drums, 40 of the first to fourth cartridges P (PY, PM, PC, PK) contacts a peripheral surface of the transfer belt 12 at a lower surface thereof. A contact portion therebetween is a primary transfer portion. Inside the transfer belt 12, a primary transfer roller 16 is provided opposed to the photosensitive drum 40. By applying a primary transfer voltage to the primary transfer roller 16, at the primary transfer portion, the toner image is transferred from the photosensitive drum 40 onto the transfer belt 12. A secondary transfer roller 14 is contacted to the transfer belt 12 toward the driving roller 17. A contact portion between the transfer belt 12 and the secondary transfer roller 14 is a secondary transfer portion.

Below the intermediary transfer belt unit 11, a feeding unit 18 is provided. This feeding unit 18 includes a paper feeding tray 19 in which the recording material S is stacked and accommodated and includes a paper feeding roller 20. The recording material S is fed from the paper feeding tray 19 to the secondary transfer portion by the paper feeding roller 20.

At an upper left portion inside the apparatus main assembly 2 in FIG. 2, a fixing unit 21 and a discharging unit 22 are provided. An upper surface of the apparatus main assembly 2 constitutes a discharge tray 23. On the recording material S on which the toner image is transferred at the secondary transfer portion, the toner image is fixed by a fixing means provided in the fixing unit 21, and then the recording material S is discharged onto the discharge tray 23.

(Metal Plate-combined Frame)

Figure 3:
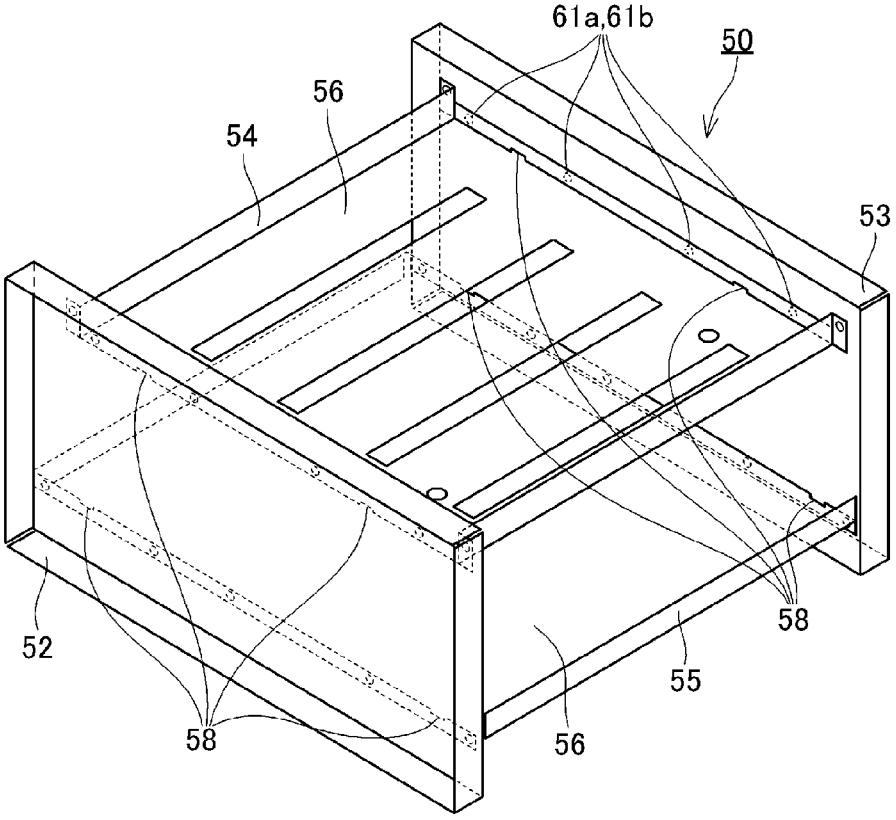
FIG. 3 is a perspective view of an outer appearance of a metal plate-combined frame in the embodiment.
Figure 4:
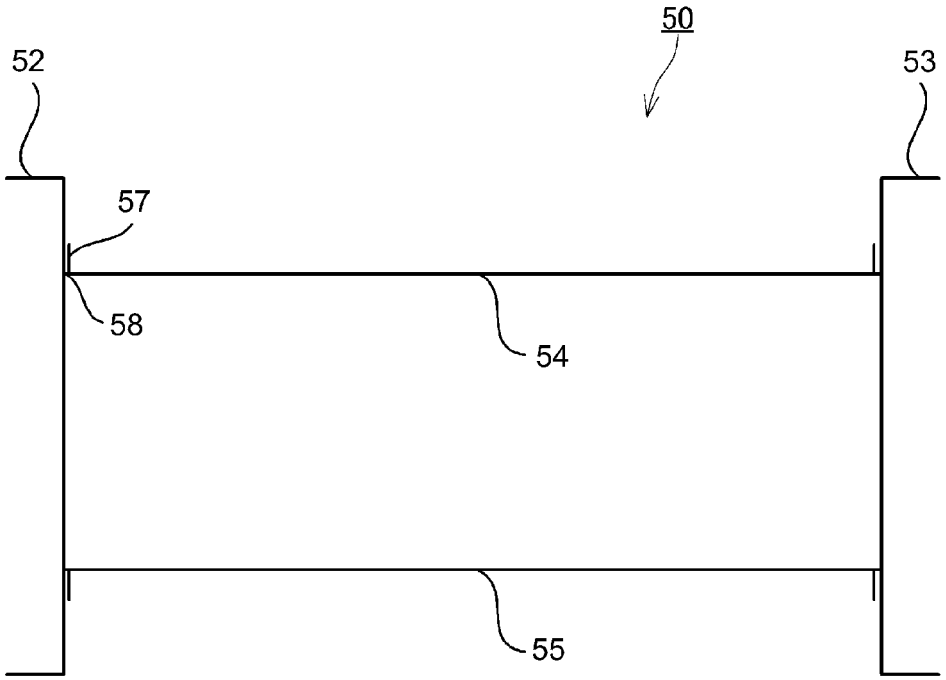
FIG. 4 is a schematic sectional view of the metal plate-combined frame in the embodiment.

Next, with reference to FIGS. 3 and 4, a metal plate-combined frame 50 in this embodiment will be described. FIG. 3 is a perspective view of an outer appearance of the metal plate-combined frame 50 in this embodiment. FIG. 4 is a schematic sectional view of the metal plate-combined frame 50 in this embodiment.

An image forming apparatus frame of the image forming apparatus in this embodiment is constituted by the metal plate-combined frame 50 shown in FIG. 3. The metal plate-combined frame 50 includes side plates (left side plate 52 and right side plate 53) as a pair of second plate members, an optical stay 54 as a first plate member, and a main stay 55. The first plate member and the second plate member are members manufactured by processing a metal-made plate member (metal plate) into a desired shape by press machining or the like.

As shown in FIGS. 3 and 4, the left side plate 52 and the right side plate 53 are provided in parallel to each other, and between these side plates, the optical stay 54 and the main stay 55 are provided. The optical stay 54 positions and supports optical parts such as the laser scanner unit LS described above, and the main stay 55 positions and supports a frame of a transfer device such as the intermediary transfer belt unit 11 described above and an unshown manual feeding unit. Hereinafter, the optical stay 54 and the main stay 55 are referred to as a supporting stay. The left and right side plates 52 and 53 and the supporting stays 54 and 55 are provided perpendicularly (vertically) to each other and are fixed. A frame for the intermediary transfer belt unit 11 supports and positions the first to fourth cartridges P (PY, PM, PC, PK).

Each of the supporting stays 54 and 55 includes a flat plate portion 56 provided vertically to the left and right side plates 52 and 53. At an edge portion of the flat plate portion 56 fixed to each of the left and right side plates 52 and 53, the supporting stays 54 and 55 are provided with projected portions 58 as positioning portions for positioning the left and right side plates 52 and 53 relative to the supporting stays 54 and 55 by vertically abutting against the left and right side plates 52 and 53. Further, the supporting stays 54 and 55 are provided with bent portions 57 including portions-to-be-fixed 61*b* (described later specifically) to be fixed to the left and right side plates 52 and 53 while extending along the left and right side plates 52 and 53. Each of the projected portions 58 positions an associated one of the left and right side plates 52 and 53 relative to an associated one of the supporting stays 54 and 55, and ensures distance accuracy between the left and right side plates 52 and 53.

(Bent Portion and Projected Portion)

Figure 5:
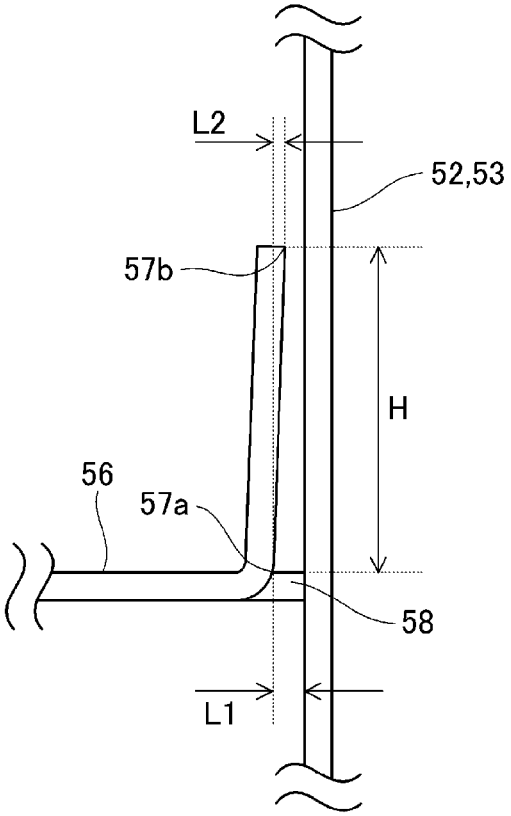
FIG. 5 is an enlarged view showing a periphery of a bent portion and a projected portion of a supporting stay.

Next, with reference to FIG. 5, details of the bent portions 57 and the projected portions 58 of the supporting stays 54 and 55 will be described. FIG. 5 is an enlarged view showing a periphery of the bent portion and the projected portion of the supporting stay.

As shown in FIG. 5, a projection amount of the projected portion 58 from a base portion 57*a* of the bent portion 57 is L1. A projection amount of a free end portion 57*b* of the bent portion 57 from the base portion 57*a* of the bent portion 57 is L2. Further, a (bending) length from the base portion 57*a* to the free end portion 57*b* of the bent portion 57 is H.

The projection amounts L1 and L2 are required to satisfy a relationship of L1≥L2. This is because the projected portion 58 is caused to abut against the left side plate 53 or the right side plate 53 with reliability. When the relationship between L1 and L2 is reversed (L1<L2), the free end portion 57*b* of the bent portion 57 abuts against the left side plate 52 or the right side plate 53, so that a spacing (gap) is formed between the projected portion 58 and the associated one of the left and right side plates 52 and 53. The reason why the projected portion 58, not the bent portion 57, is caused to abut against the associated one of the left and right side plates 52 and 53 is that the projected portion 58 is capable of improving the distance accuracy between the left and right side plates 52 and 53 more than the bent portion 57. In this way, with respect to a direction in which the flat plate portion 56 extends, a free end of the projected portion 58 is disposed at a position closer to the left and right side plates 52 and 53 than from the free end portion 57*b* of the bent portion 57 to the left and right side plates 52 and 53.

(Fixing Method of Left and Right Side Plates and Supporting Stays)

Figure 7:
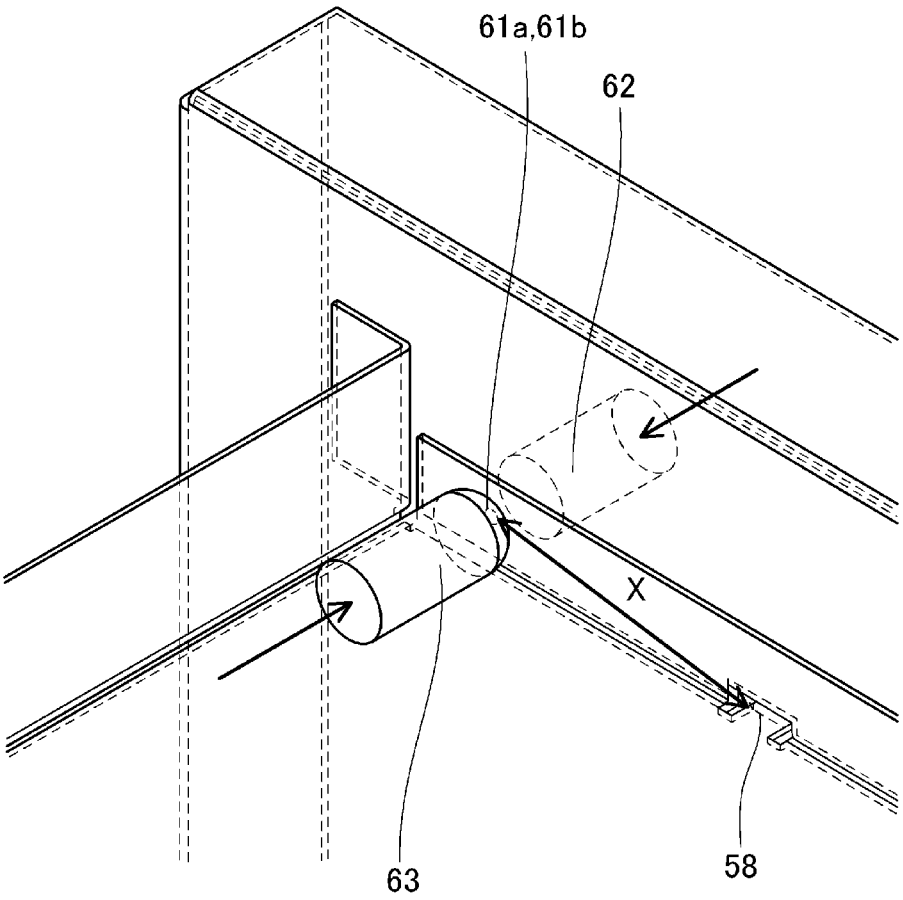
FIG. 7 is a schematic view for illustrating a distance between a portion-to-be-fixed and the projected portion.
Figure 8:
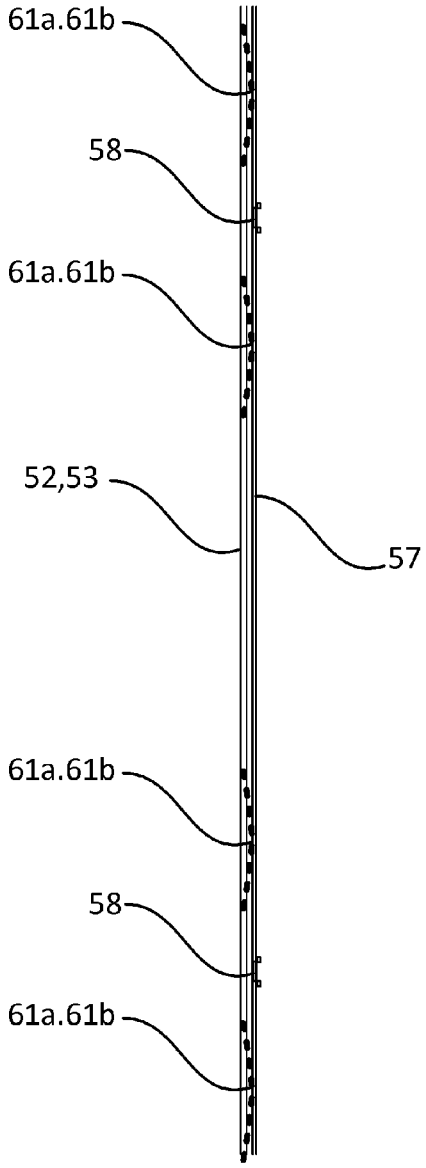
FIG. 8 is a schematic view showing a fixed state of the left and right side plates and the supporting stay.
Figure 9:
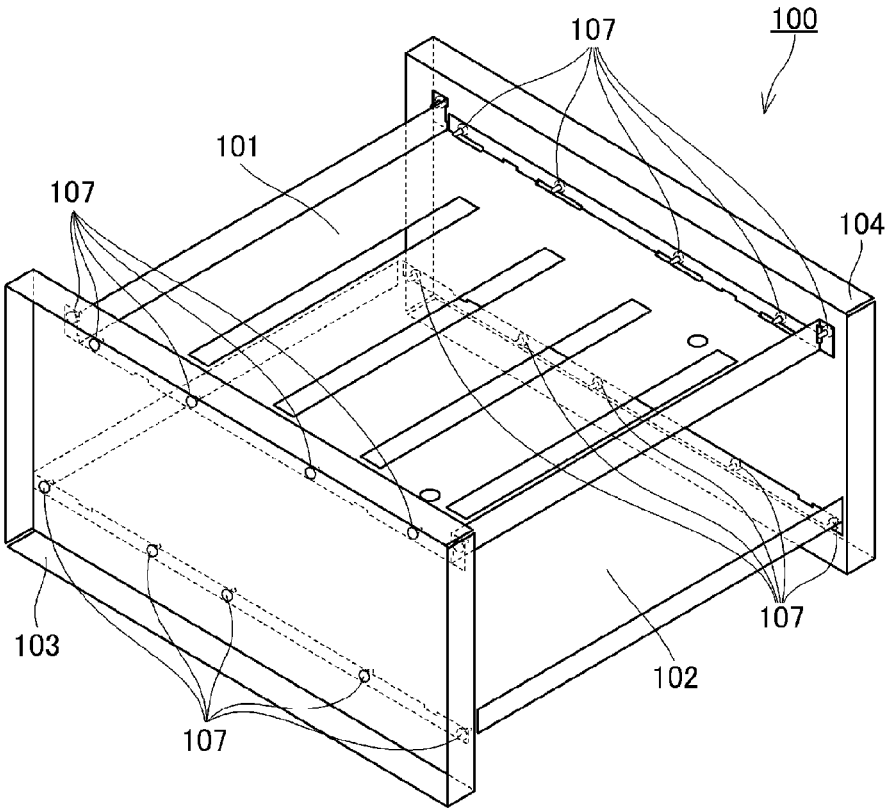
Fig. 9 PRIOR ART
FIG. 9 is a perspective view of an outer appearance of a metal plate-combined frame in a conventional example.
Figure 10:
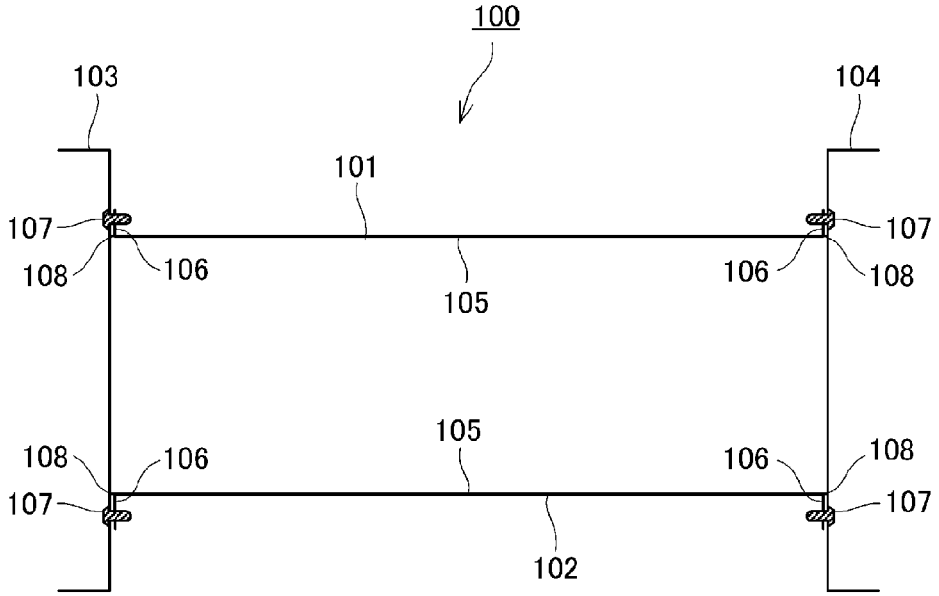
Fig. 10 PRIOR ART
FIG. 10 is a schematic sectional view of the metal plate-combined frame in the conventional example.
Figure 11:
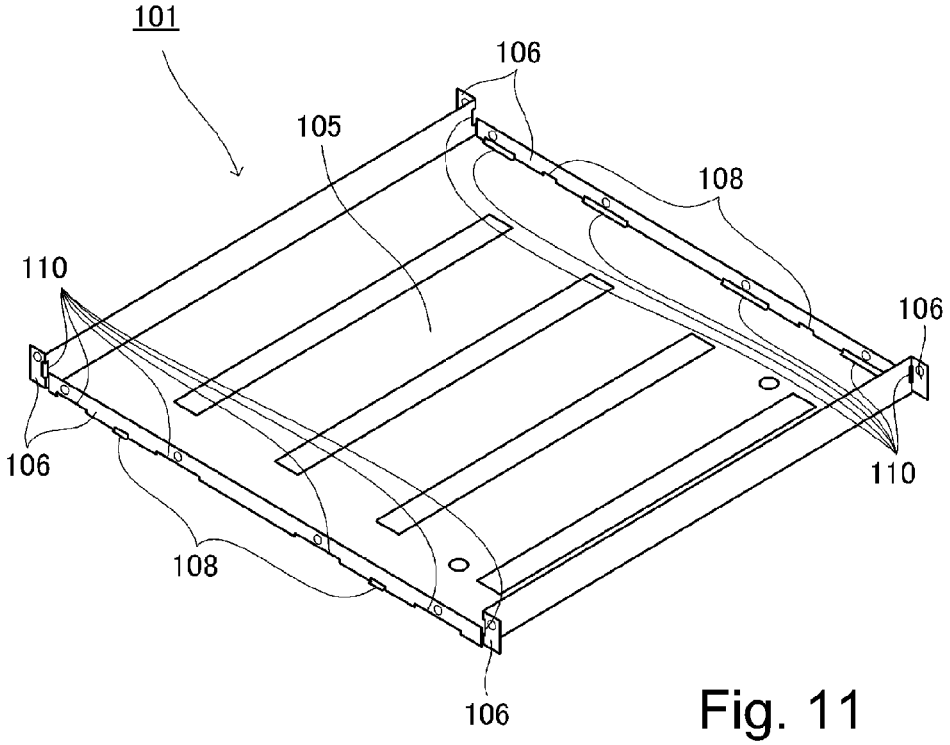
Fig. 11 PRIOR ART
FIG. 11 is a perspective view of an outer appearance of an optical stay in the conventional example.
Figure 12:
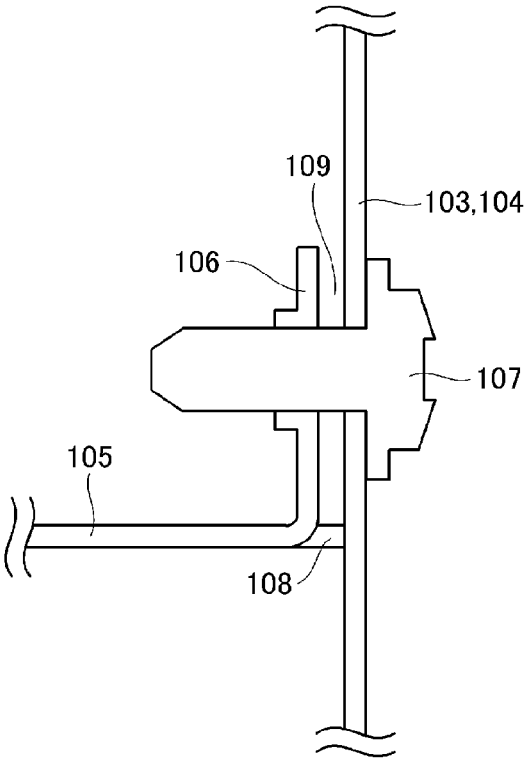
Fig. 12 PRIOR ART
FIG. 12 is a schematic view for illustrating fastening between the optical stay and a side plate in the conventional example.
Figure 13:
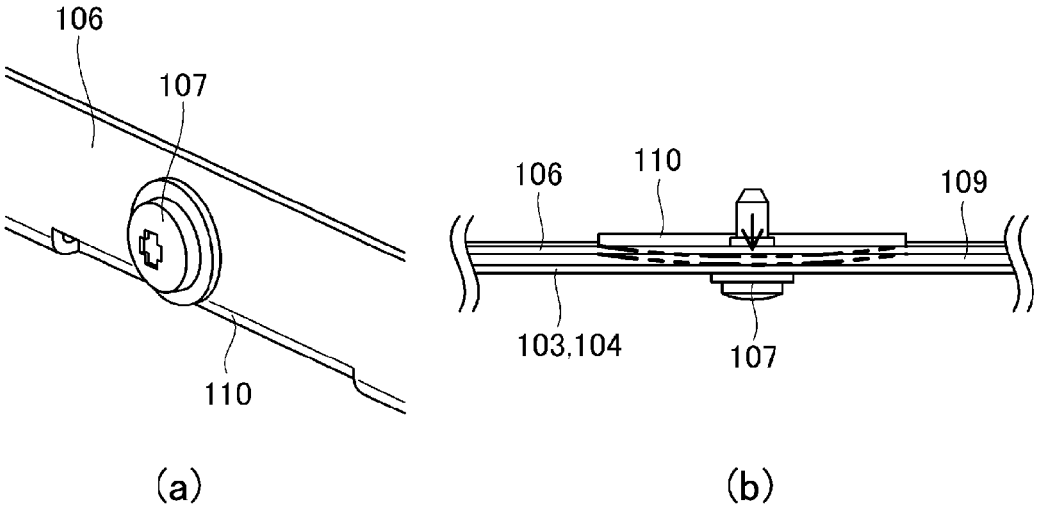
Fig. 13 PRIOR ART
In FIG. 13, (a) and (b) are schematic views for illustrating fastening between a bent portion and the side plate in the conventional example.
Figure 14:
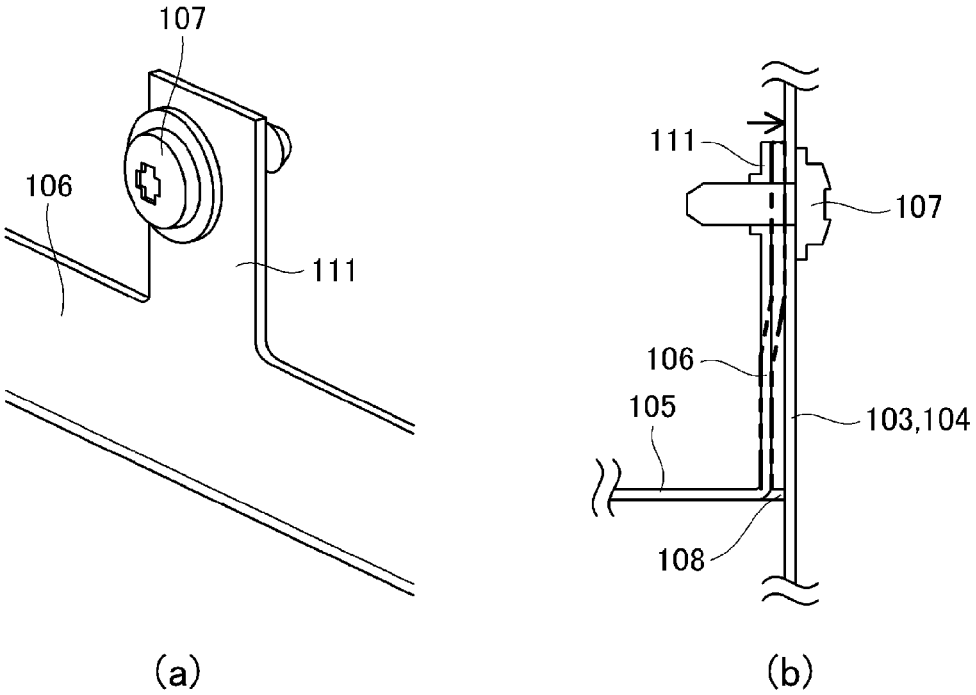
Fig. 14 PRIOR ART
In FIG. 14, (a) and (b) are schematic views for illustrating fastening between a bent portion and the side plate in the conventional example.

Next, with reference to FIGS. 6 to 8, as a manufacturing method of the metal plate-combined frame, a fixing method of the left and right side plates and the supporting stays will be described. In this embodiment, welding was used as the fixing method of the left and right side plates 52 and 53 and the supporting stays 54 and 55. The fixing method of the left and right side plates and the supporting stays includes a positioning step and a fixing step.

Figure 6:
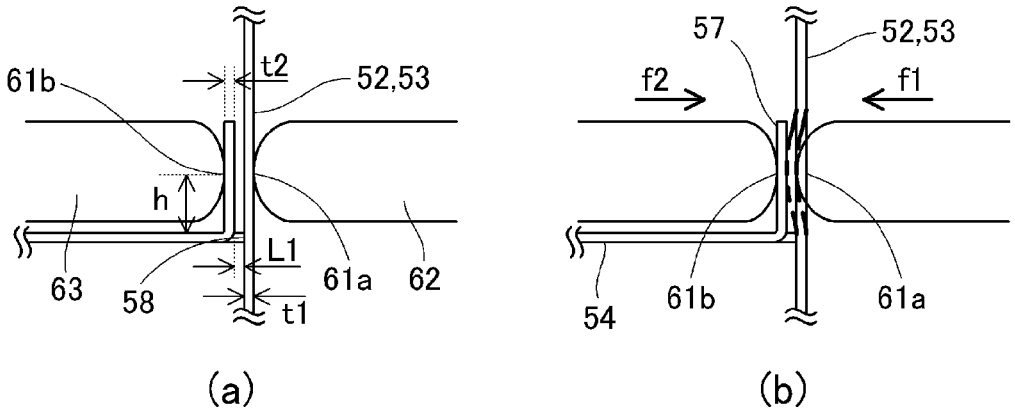
In FIG. 6, (a) and (b) are schematic views for illustrating a fixing method of left and right side plates and the supporting stay in the embodiment.

In FIG. 6, (a) and (b) are schematic views for illustrating the fixing method of the left and right side plates and the supporting stays. In FIG. 6, (a) shows a state before the left and right side plates are fixed by the welding, and (b) shows a state in which the left and right side plates are deformed for fixing the left and right side plates by the welding. As shown in (a) of FIG. 6, a plate thickness of each of the left and right side plates 52 and 53 is t1, and a plate thickness of each of the supporting stays 54 and 55 is t2. FIG. 7 is a schematic view for illustrating a distance between the portion-to-be-fixed and the projected portion. FIG. 8 is a schematic view showing a fixed state, between the left or right side plate and the associated supporting stay, as seen from above the metal plate-combined frame 50.

First, the projected portions 58 of the supporting stays 54 and 55 are abutted against the left and right side plates 52 and 53 to perform positioning of the left and right side plates 52 and 53 relative to the supporting stays 54 and 55 (developing step).

Then, the fixing step will be described. In the state in which the left and right side plates 52 and 53 are positioned relative to the supporting stays 54 and 55, a pair of electrode members 62 and 63 for sandwiching the left or right side plate 52 or 53 and the associated one of the supporting stays 54 and 55 is provided. An electrode member contacting the left or right side plate 52 or 53 is the electrode member 62, and an electrode member contacting the associated one of the supporting stays 54 and 55 is the electrode member 63.

Of the portions sandwiched between the pair of electrode members 62 and 63, the portion positioned in the side of the left or right side plate 52 or 53 is a fixing portion 61*a*, and the portion positioned in the side of the associated one of the supporting stays 54 and 55 is a portion-to-be-fixed 61*b*. The fixing portion 61*a* and the portion-to-be-fixed 61*b* which are sandwiched between the electrode members 62 and 63 are locally pressed. Then, the fixing portion 61*a* is deformed toward the portion-to-be-fixed 61*b* of the bent portion 57 and thus is closely contacted to the portion-to-be-fixed 61*b*, so that a current generates between the electrode members 62 and 63. By the generation of the current, the left and right side plates 52 and 53 are heated and melted. As a result, the fixing portion 61*a* and the portion-to-be-fixed 61*b* are welded to each other. In this way, the left and right side plates 52 and 53 and the supporting stays 54 and 55 are welded to each other. In this embodiment, as shown in FIG. 6, a free end of each of the electrode members 62 and 63 has a roller shape so that pressure is easily concentrated.

Further, details of the fixing step will be described. As shown in FIG. 6, the projected portion 58 projects from the edge portion of the supporting stay 54 or 55 in the projection amount L1. Therefore, as shown in (a) of FIG. 6, before the fixing portion 61*a* and the portion-to-be-fixed 61*b* are heated and pressed by the electrode members 62 and 63, a gap corresponding to approximately the projection amount L1 is formed the fixing portion between 61*a* of the left or right side plate 52 or 53 and the portion-to-be-fixed 61*b* of the bent portion 57. This is because as described above, the free end of the projected portion 58 is disposed at the position where the projected portion free end projects toward the left or right side plate 52 or 53 (the second plate member) more than the portion-to-be-fixed 61*b* of the bent portion 57. Further, the above-described current cannot be generated when the fixing portion 61*a* and the portion-to-be-fixed 61*b* are not closely contacted to each other.

In the fixing step in this embodiment, the electrode member 62 in the side of the left or right side plate is urged toward the associated supporting stay with an urging force f1 indicated by an arrow in FIG. 6 by an unshown urging means. As a result, the electrode member 62 locally deforms the fixing portion 61*a* of the left or right side plate 52 or 53 in the projection amount L1, so that the fixing portion 61*a* is contacted to the portion-to-be-fixed 61*b* of the bent portion 57.

At this time, the electrode member 63 in the supporting stay side contacts the bent portion 57 is urged (pressed) from a direction, opposite to the direction in which the electrode member 62 is urged, with an urging force f2 to the extent such that the electrode member 62 is not pushed by the urging force f1 of the electrode member 62. The urging force f1 losses in an amount such that the urging force f1 of the electrode member 62 in the side of the left or right side plate deforms the fixing portion 61*a* of the left or right side plate 52 or 53, and therefore the urging force f2 of the electrode member 63 in the supporting stay side is set so as to be weaker than the urging force f1.

In the fixing step in this embodiment, both of the electrode member 62 for the left or right side plate and the electrode member 63 for the supporting stay are urged, but a constitution in which only the electrode member 62 for the left or right side plate is urged while fixing the electrode member 63 for the supporting stay at a position where the electrode member 63 contacts the bent portion 57 may also be employed.

In the fixing step in this embodiment, the urging force f1 of the electrode member 62 for the left or right side plate was about 30 kgf, and the urging force f2 of the electrode member 62 for the supporting stay was about 20 kgf. The plate thickness t1 of each of the left and right side plates 52 and 53 is set to satisfy a range of 0.6 mm or more and 1.2 mm or less, and the plate thickness t2 of each of the supporting stays 54 and 55 is set to satisfy a range of 0.6 mm or more and 1.2 mm or less.

Further, a constitution in which the position of the portion-to-be-fixed 61*b* and the position of the projected portion 58 are spaced and shifted by a predetermined distance with respect to a direction (longitudinal direction of the bent portion 57) in which an edge line of a bent portion extends when the bent portion 57 is provided by bending the associated one of the supporting stays 54 and 55 was employed. Specifically, as shown in FIG. 7, the positions of the portion-to-be-fixed 61*b* and the projected portion 58 closest to the portion-to-be-fixed 61*b* are shifted so that a distance X between the portion-to-be-fixed 61*b* and the projected portion 58 is 15 mm or more. In the case where the press X is set so as to be shorter than 15 mm, the urging force f1 for bringing the fixing portion 61*a* for the left or right side plate 52 or 53 into contact with the portion-to-be-fixed 61*b* is required to be considerably increased because the projected portion 58 exists in the opposite side. In this embodiment, the plate thickness t1 of each of the left and right side plates 52 and 53 is 0.6 mm or more and 1.2 mm or less, and therefore in the case where the distance X is made shorter than 15 mm, the urging force f1 for each of the left and right side plates 52 and 53 is required to be set at 30 kgf or more in some cases. This is because it becomes difficult to ensure a space in which an urging means for urging the electrode member 63 is to be disposed.

As described above, in the case where the distance X is set so as to be 15 mm or more, the metal plate-combined frame 50 in this embodiment has the following shape in the state in which the left and right side plates 52 and 53 and the supporting stays 54 and 55 are fixed. That is, as shown in FIG. 8, in the case where a portion of the left and right side plates 52 and 53 of the metal plate-combined frame 50 is seen from above, the left and right side plates 52 and 53 are deformed so as to contact the projected portions 58 and the portions-to-be-fixed 61*b* of the supporting stays 54 and 55 to assume a wavy shape such that the projected portions 58 and the portions-to-be-fixed 61*b* constitute a deformed portion (belly portion). In this way, in this embodiment, a constitution in which the left and right side plates 52 and 53 are positively deformed (curved) so as to bring the projected portions 58 and the portions-to-be-fixed 61*b* of the supporting stays 54 and 55 into contact with the left and right side plates 52 and 53 was employed. As a result, there is no need to employ a constitution, as in the conventional example, in which the bent portions 57 provided with the portions-to-be-fixed 61*b* for the supporting stays 54 and 55 are positively deformed.

In order to realize close contact between the fixing portion 61*a* and the portion-to-be-fixed 61*b*, a constitution in which the portion-to-be-fixed 61*b* of the bent portion 57 is deformed by urging of the electrode member 63 for the supporting stay would be also considered, but the following problem generates. As in this embodiment, the portion-to-be-fixed 61*b* is close to the base portion 57*b* of the bent portion 57, and a shape, for decreasing rigidity, such as a slit or hole does not exist at a periphery of the portion-to-be-fixed 61*b*. For this reason, rigidity against the deformation of the metal plate-combined frame 50 is high. In this embodiment, a distance h ((a) of FIG. 6) between the base portion 57*a* and the portion-to-be-fixed 61*b* is 4 mm or more and 10 mm or less. Therefore, compared with the urging force f1 when the fixing portion 61*a* of each of the left and right side plates is deformed, the urging force f2 for the supporting stay is required to be considerably increased. In this embodiment, the plate thickness t2 of each of the supporting stays 54 and 55 is 0.6 mm or more and 1.2 mm or less, and therefore in order to deform the portion-to-be-fixed 61*b*, the urging force f2 of the electrode member 63 for each of the supporting stays 54 and 55 is required to be set at 30 kgf or more in some cases. In this case, it becomes difficult to ensure a space in which an urging means for urging the electrode member 63 is to be disposed.

Further, when the urging force f2 of the electrode member 63 for the supporting stay is set so that the urging force f2 is set to push the electrode member 62 urged by the urging force f1, the left and right side plates 52 and 53 are deformed toward an outside the main assembly constituting frame. At this time, the projected portions 58 of the supporting stays 54 and 55 are spaced from the left and right side plates 52 and 53 in some cases, and therefore there is a liability that the distance accuracy between the side plates cannot be ensured.

In order to facilitate the deformation of the portion-to-be-fixed 61*b* of the bent portion 57 by urging of the electrode member 63 for the supporting stay, compared with the constitution in which the bent portion 57 is provided with the slit or the like as in the constitution in the conventional example, when the constitution in this embodiment is employed, frame rigidity of the frame as a whole can be maintained. Further, compared with the constitution in which the narrow projected portion is provided at the bent portion 57 as in the conventional example, when the constitution in this embodiment is employed, there is no need to provide the narrow projected portion at the bent portion 57, so that it is possible to suppress upsizing of the supporting stays 54 and 55.

As described above, in the metal plate-combined frame 50 in this embodiment, it is possible to maintain rigidity of the metal plate-combined frame 50 while suppressing the increase in cost of the product and the upsizing of the image forming apparatus, and it is possible to fix the left and right side plates 52 and 53 with the supporting stays 54 and 55 with high positional accuracy.

In the metal plate-combined frame 50, it is preferable that the projection amount L1 is 0.1 mm or more and 0.3 mm or less, the projection amount L2 is 0±about 0.1 mm, and the bending length H is 8 mm or more and 20 mm or less. The projection amount L2 becomes larger with a longer bending length H, and therefore if the bending length H is made longer than 20 mm, the projection amount L2 is required to be set so as to be larger than a value of the projection amount L1. At this time, there is a need to increase also a deformation amount of the fixing portion 61*a* of the left and right side plates 52 and 53, and therefore the urging force of the electrode member 62 is required to be made high, so that it is difficult to ensure the space in which the urging means is disposed. On the other hand, in the case where the bending length H is made smaller than 8 mm, bending rigidity and torsional rigidity of the supporting stays 54 and 55 themselves lower, so that the frame rigidity becomes insufficient. Further, there is no space in which the electrode members 62 and 63 are disposed, and therefore it is difficult to employ the fixing method in this embodiment.

In order to bring the projected portions 58 and the portions-to-be-fixed 61*b* of the supporting stays 54 and 55 into contact with the left and right side plates 52 and 53, if the left and right side plates 52 and 53 are deformed, the fixing method between the fixing portions 61*a* and the portions-to-be-fixed

61*b* is not limited to the welding, but may also be fixing using fastening with screws. The flat plate portions 56 of the supporting stays 54 and 55 are vertically to the left and right side plates 52 and 53, but may only be required to satisfy a crossing relationship.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 016830/2014 filed Jan. 31, 2014, which is hereby incorporated by reference.

What is claimed is:

1. A frame for an image forming apparatus, comprising:

a first plate member;

a second plate member;

a bent portion provided as a part of said first plate member and bent along said second plate member;

a portion-to-be-fixed provided as a part of said bent portion and to be fixed to said second plate member;

a positioning portion, provided on said first plate member, for positioning said second plate member relative to said first plate member by being abutted vertically against said second plate member, said positioning portion having a free end projecting toward said second plate member more than said portion-to-be-fixed; and a fixing portion, provided as a part of said second plate member, to which said portion-to-be-fixed is fixed, wherein said second plate member is deformed so that said fixing portion projects toward, contacts, and deforms said portion-to-be-fixed while said second plate member is in contact with said positioning portion, and said fixing portion is welded to said portion-to-be-fixed, so that said first plate member and said second member are fixed to each other.

2. A frame according to claim 1, wherein when said fixing portion is welded to said portion-to-be-fixed, said fixing portion is pressed in a direction of projecting toward said portion-to-be-fixed and said portion-to-be-fixed is pressed from a direction opposite to a direction in which said fixing portion is pressed.

3. A frame according to claim 2, wherein a force for pressing said fixing portion is larger than a force for pressing said portion-to-be-fixed.

4. A frame according to claim 1, wherein each of said first plate member and said second plate member is a plate member formed of metal.

5. A frame according to claim 1, wherein a closest distance between said positioning portion and said portion-to-be-fixed is 15 mm or more.

6. A frame according to claim 1, wherein said second plate member has a thickness of 0.6 mm or more and 1.2 mm or less.

7. A frame according to claim 1, wherein said first plate member supports an exposure unit for exposing a photosensitive member to light.

8. A frame according to claim 1, wherein said first plate member supports a transfer unit onto which a toner image is to be transferred from a photosensitive member.

9. A manufacturing method of a frame for an image forming apparatus, wherein the frame includes a first plate member, a second plate member, a positioning portion, provided on the first plate member, for positioning the second plate member relative to the first plate member by being abutted vertically against the second plate member, a bent portion provided as a part of the first plate member and bent along the second plate member, a portion-to-be-fixed provided as a part of the bent portion and to be fixed to the second plate member, and a fixing portion, provided as a part of the second plate member, to which the portion-to-be-fixed is fixed, and wherein a free end of the positioning portion is disposed in a position where the free end projects toward the second plate member more than the portion-to-be-fixed, said manufacturing method comprising:

a positioning step of positioning the second plate member relative to the first plate member by vertically abutting the positioning portion against the second plate member; and a fixing step of fixing the first plate member and the second plate member to each other by deforming the second plate member to contact and deform the fixing portion to the portion-to-be-fixed while the second plate member is in contact to the positioning portion and welding the fixing portion and the portion-to-be-fixed to each other.

10. A frame for an image forming apparatus, comprising:

a first plate member;

a second plate member;

a bent portion provided as a part of said first plate member and bent along said second plate member;

a portion-to-be-fixed provided as part of said bent portion and to be fixed to said second plate member;

a positioning portion, provided on said first plate member, for positioning said second plate member relative to said first plate member by being abutted vertically against said second plate member, wherein a free end of said positioning portion is disposed in a position where the free end projects toward said second plate member more than said portion-to-be-fixed; and a fixing portion, provided as a part of said second plate member, to which said portion-to-be-fixed is fixed, wherein said second plate member is deformed toward said bent portion at said fixing portion, and there is a gap between said second plate member and said bent portion at a peripheral portion of said positioning portion.

11. A frame according to claim 10, wherein the first plate member and the second plate member are fixed by welding the fixing portion and the portion-to-be-fixed to each other.

12. A frame according to claim 10, wherein each of said first plate member and said second plate member is a plate member formed of metal.

13. A frame according to claim 10, wherein a closest distance between said positioning portion and said portion-to-be-fixed is 15 mm or more.

14. A frame according to claim 10, wherein said second plate member has a thickness of 0.6 mm or more and 1.2 mm or less.

15. A frame according to claim 10, wherein said first plate member supports an exposure unit for exposing a photosensitive member to light.

16. A frame according to claim 10, wherein said first plate member supports a transfer unit onto which a toner image is to be transferred from a photosensitive member.

* * * * *